US009732464B2

(12) United States Patent
Chen

(10) Patent No.: US 9,732,464 B2
(45) Date of Patent: Aug. 15, 2017

(54) METHOD FOR PRODUCING WATER REPELLENT DOWN

(71) Applicant: KWONG LUNG ENTERPRISE CO., LTD., Taipei (TW)

(72) Inventor: Chang-Cheng Chen, Taipei (TW)

(73) Assignee: KWONG LUNG ENTERPRISE CO., LTD., Taipei (TW)

( * ) Notice: Subject to any disclaimer, the term of this patent is extended or adjusted under 35 U.S.C. 154(b) by 183 days.

(21) Appl. No.: 14/608,588

(22) Filed: Jan. 29, 2015

(65) Prior Publication Data

US 2016/0222581 A1 Aug. 4, 2016

(51) Int. Cl.

| | |
|---|---|
| ***D06M 19/00*** | (2006.01) |
| ***D06M 15/643*** | (2006.01) |
| ***D06M 13/203*** | (2006.01) |
| ***D06M 13/395*** | (2006.01) |
| ***D06M 15/256*** | (2006.01) |
| ***D06M 15/657*** | (2006.01) |

(52) U.S. Cl.

CPC ..... *D06M 19/00* (2013.01); *D06M 13/203* (2013.01); *D06M 13/395* (2013.01); *D06M 15/256* (2013.01); *D06M 15/643* (2013.01); *D06M 15/657* (2013.01)

(58) Field of Classification Search

None

See application file for complete search history.

(56) References Cited

U.S. PATENT DOCUMENTS 2,925,315 A * 2/1960 Pasternak ..... A41G 9/00 424/600
4,537,594 A * 8/1985 Fleet ..... D06M 19/00 428/389

(Continued)

FOREIGN PATENT DOCUMENTS

JP 3383855 A 3/2003
TW I304450 B 12/2008

(Continued)

OTHER PUBLICATIONS

Caplus and wpix abstracts of CN 103485186, Jan. 2014.*

(Continued)

*Primary Examiner* — Erma Cameron
(74) *Attorney, Agent, or Firm* — Rabin & Berdo, P.C.

(57) ABSTRACT

A method for producing water repellent down includes soaking cleaned down in an aqueous solution having a pH ranging from 4 to 7; adding to the solution a cross-linking agent composed of a material having an isocyanate or acrylic acid functional group to provide a solution having a weight ratio of the down and the cross-linking agent ranging between 1:0.005 and 1:0.06; adding to the solution a water-drawing agent composed of a material having a siloxane functional group to provide a solution having a weight ratio of the down and the water-drawing agent ranging between 1:0.01 and 1:0.1; stirring the solution for at least 15 minutes to react the cross-linking agent and the water-drawing agent and form a water repellent layer on the surface of the down; separating the down from the solution; and oven drying the down with hot air having a temperature of at least 120° C.

9 Claims, 1 Drawing Sheet

(56) References Cited

U.S. PATENT DOCUMENTS

| | | | | |
|---|---|---|---|---|
| 4,693,917 | A * | 9/1987 | Geloen | D06M 19/00 19/0.27 |
| 2003/0075289 | A1* | 4/2003 | Stoltz | C07K 16/22 162/20 |
| 2011/0159299 | A1* | 6/2011 | Linforf | B05D 1/36 428/447 |

FOREIGN PATENT DOCUMENTS

| | | | |
|---|---|---|---|
| TW | I348894 | B | 9/2011 |
| TW | 201326512 | A | 7/2013 |
| TW | I414662 | B | 11/2013 |

OTHER PUBLICATIONS

Machine translation of CN 103485186, Jan. 2014.*
Taiwan Patent Office, Office Action and Search Report, Patent Application Serial No. TW103132423, Oct. 20, 2015, Taiwan.

* cited by examiner

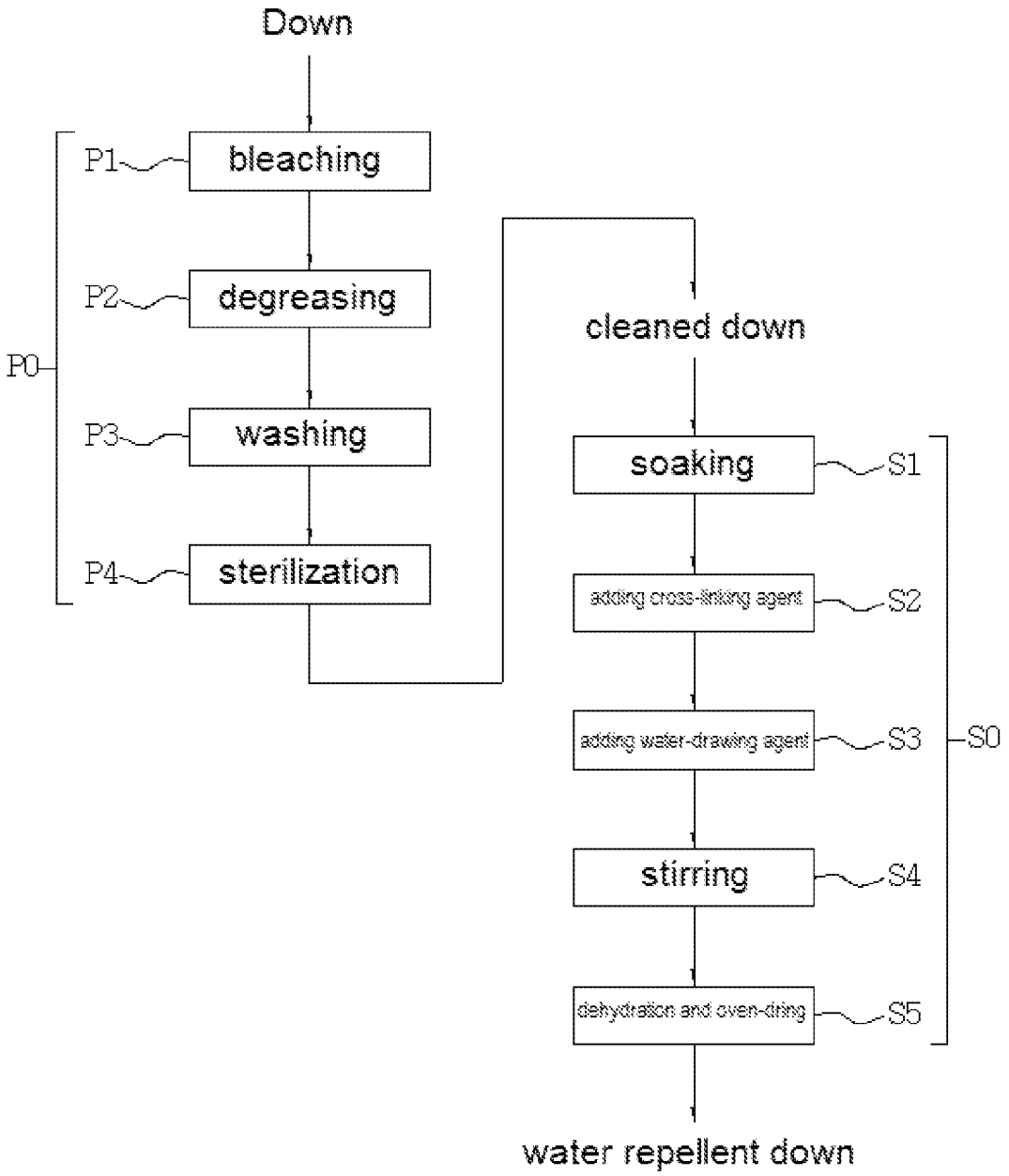
Down
P1
bleaching
P2
degreasing
P0
P3
washing
P4
sterilization
cleaned down
soaking
S1
adding cross-linking agent
S2
adding water-drawing agent
S3
S0
stirring
S4
dehydration and oven-drying
S5
water repellent down

METHOD FOR PRODUCING WATER REPELLENT DOWN

FIELD OF THE INVENTION

The present invention relates to a production method of a water repellent down, which can prevent down from becoming damp and lose its capability heat retention, and also relates to a down product produced by using said method.

DESCRIPTION OF THE RELATED ART

Down and feather grow on the bodies of ducks and geese. Duck and geese are water birds that can live on water, and therefore, down and feather have the inherent water repellent ability. However, the grease found on the surface of down and feather has a fishy smell that is originally present on ducks and geese. As a result, in order to use these materials in products, first of all, a cleaning process is required, by which most of the grease found on the surface of duck and goose fine hair would be removed, and which also reduces the water repellent characteristic of down.

Feather and down have the characteristics of being light, preserving heat, and keeping warm air within textile; and therefore, they are processed and used in warm products, for instance down jackets, down quilts, or sleeping bags etc. When these kinds of warm products (insulation product) are worn on or cover a user's body, they preserve all the heat emitted from the body of the user, and thus achieve the purpose of keeping the user warm and defending him/her against cold. They are also light, and thus don't restrict the movement of the user.

As mentioned before, feather and down have high insulation characteristic, but they are quite sensitive to moisture. After coming into contact with water vapor, feather and down tend to stick together easily, and while they don't provide insulation in this state, it is very hard to dry them and restore to their original state. If the body discharges great amount of sweat or moisture rapidly, the down that gathers and sticks together would lose its insulation ability and cause the user have insufficient warmth and easily catch cold.

SUMMARY OF THE INVENTION

In the light of the above given reasons, the present application owners have especially invested in great amount of research and development, resources, and efforts about the innovation in said field with the hope of providing a novel technique to solve related problems and thus provide a beneficial product for the society and promote industrial development.

In order to provide a simpler and clearer description, the down product disclosed in the present description comprises a mixture of down and feather, which is equal to above given descriptions.

The water repellent down produced with the present invention prevents down from agglomerating after being affected by damp, and therefore, even if the user discharges great amount of sweat or water vapor, the down would still preserve its original state, keep the heat inside, provide warming function for the wearer, and thus overcome the known problems of the prior art.

In order to achieve above said purposes, the water repellent down of the present invention, the surface of the down is clad by a water repellent layer, wherein said water repellent layer is formed of a water-drawing agent comprising a fluoride or siloxane functional group. When said water repellent layer is installed, water wouldn't be kept on the down and no down would be affected by water and thus agglomeration wouldn't occur, so that the known drawbacks of the prior art could be overcome.

In order to clad the water repellent layer on the down in a favorable manner, the means adopted by the present invention water repellent down production method comprises: a soaking step, a cross-linking agent addition step, a water-drawing agent addition step, a stirring step, and a dehydration and oven-drying step.

Soaking step relates to soaking of the cleaned down into a solution with pH between 4 and 7, so that the down would be adequately wet and ready for the following cross-linking reaction; cross-linking agent addition step relates to addition of a cross-linking agent comprising an isocyanate or acrylic acid functional group into the solution, such that the weight ratio of the down and the cross-linking agent would be between 1:0.005 to 1:0.06; water-drawing agent addition step relates to addition of a water-drawing agent comprising a fluorocarbon or siloxane functional group into the solution, such that the weight ratio of the down and the water-drawing agent would be between 1:0.01 to 1:0.1; stirring step relates to mixing continuously for at least 15 minutes after addition of the cross-linking agent and the water-drawing agent, so that by means of continuous stirring, the down is allowed to adequately react in three-dimensional space and the water-drawing agent is adhered homogeneously on the down; dehydration and oven-drying step relates to separation of the down and the solution via draining and dehydration following completion of the reaction, and then the down is oven-dried with air heated over 120° C.; and after oven-drying is complete, water repellent down is obtained by cooling to room temperature.

By means of the cross-linking reaction occurring between the water-drawing agent of the present invention and the cross-linking agent, the water-drawing agent is properly clad over the down surface, so that it wouldn't come off due to stirring, oven-drying, wind blow etc. processes, and also the produced water repellent down has favorable water repellency and the water repellent layer becomes much more long-lasting and durable. Besides, the manufacturing process of the present invention is simple and convenient, which enables quick and efficient mass production, reduces processing costs, and the yield of the produced water repellent down is extremely high, and the problem of incomplete cladding of the water repellent layer is rarely encountered.

During the manufacturing process of the present invention, the weight ratio of the down and the solution can be between 1:20 and 1:35, and by means of controlling this proportion appropriately, full cross-linking reaction can be obtained on the surface of the down.

Preferably, the weight ratio of the down and the cross-linking agent can also be between 1:0.005 and 1:0.05, and the weight ratio of the down and the water drawing agent can also be between 1:0.09 and 1:0.03; and by means of arranging a good proportion between the cross-linking agent and the water-drawing agent, the reaction would be even more compete.

More preferably, the cross-linking agent comprises an isocyanate functional group with a down-to-isocyanate weight ratio between 1:0.03 and 1:0.05; and the water-drawing agent comprises a fluorocarbon functional group with a down-to-fluorocarbon weight ratio between 1:0.03 and 1:0.09.

More preferably, the cross-linking agent comprises an isocyanate functional group with a down-to-isocyanate weight ratio between 1:0.005 and 1:0.03; and the water-drawing agent comprises a siloxane functional group with a down-to-siloxane weight ratio between 1:0.05 and 1:0.07.

Preferably, the time during which stirring continues in the stirring step is limited to 30 minutes at most.

Preferably, during the dehydration and oven-drying steps, when the draining and dehydration are completed, the down is first loosened by stirring and oven-drying is carried out.

Preferably, the dehydration and oven-drying step relates to carrying out oven-drying with hot air between 120° C. and 140° C.

Preferably, the soaking step relates to addition of glacial acetic acid into the solution in order to adjust the pH value, and the pH value can also be controlled between 4 and 5.

Preferably, between the soaking step and said stirring step, the solution temperature is maintained between 20° C. and 60° C.

The water repellent down produced by the present invention process can be filled into various types of down products, such as commonly seen down jackets, down quilts, down pillows etc. By using favorable water repellency, the product can keep its fluffy and heat retention (insulating) characteristics and therefore have better quality.

In order to allow the esteemed examiner understand the contents of the present invention better, two of the most preferred embodiments are described in detail as follows:

BRIEF DESCRIPTION OF THE DRAWINGS

FIG. 1 is the flow scheme of the production method of an embodiment of the present invention.

DETAILED DESCRIPTION OF THE PREFERRED EMBODIMENTS

Down processing can be divided as pre-processing procedures (P0) and water repellent treatment procedures (S0). As shown in FIG. 1, pre-processing procedures (P0) can include a bleaching step (P1), a degreasing step (P2), a washing step (P3), and a sterilization step (P4). As mentioned above, the down disclosed in the present invention comprises a mixture of down and feather, which grow on bodies of animals such as duck and goose, and in order to be provided for daily use of people, they need to be put through appropriate processing. These processes include pre-processing procedures (P0) of the present invention, which comprise a bleaching step (P1) where the down is soaked into an oxidizing agent, a degreasing step (P2) where the down is soaked into ether, a washing step (P3) where washing by an alkaline detergent is carried out, and a sterilization step (P4) where disinfection process is carried out.

Moreover, the water repellent down production method of the present invention mainly relates to the water repellent treatment procedures (S0) that come after the pre-processing procedures (P0). In these procedures, the down cleaned through the pre-processing procedures (P0) is used and water repellent down is manufactured through a soaking step (S1), a cross-linking agent addition step (S2), a water-drawing agent addition step (S3), a stirring step (S4), and a dehydration and oven-drying step (S5).

The soaking step (S1) primarily relates to soaking of the cleaned down into a solution with a temperature between 20-60° C. and pH 4-7. Afterwards, the according to the cross-linking agent addition step (S2) and the water-drawing agent addition step (S3), the cross-linking agent and the water-drawing agent are added, respectively, wherein the cross-linking agent can be a cross-linking agent comprising an isocyanate or acrylic acid functional group, and the down-to-cross-linking agent weight ratio can be between 1:0.005 and 1:0.06; and the water-drawing agent can be a water-drawing agent comprising a fluorocarbon or siloxane functional group, and the ratio of the down and the water-drawing agent can be between 1:0.01 and 1:0.1. After the cross-linking agent and the water-drawing agent are added, stirring step (S4) is performed, wherein stirring is made continuously for 15-30 minutes to let the cross-linking agent and the water-drawing agent completely react and enable the solution have complete contact with the surface of the down, so that following the reaction, the water-drawing agent and the cross-linking agent can be adhered evenly on the surface of the down. When the reaction is completed (and after waiting until the end of the regular reaction time), dehydration and oven-drying step (S5) is performed, wherein draining and dehydration is made to separate the down and the solution, and the down is loosened by means of stirring after dehydration is complete. Afterwards, the down is oven-dried by dry air at around 120-140° C. After the down is oven-dried, it is cooled down to room temperature and thus the water repellent treatment procedures (S0) are completed.

By means of the water repellent down production method provided with the present invention, after completion of the reaction, the water-drawing agent and the cross-linking agent can be adhered evenly on the surface of the down, and following oven-drying, an intact and durable water repellent layer is produced. The water repellent down produced with the production method of the present invention, and the product obtained with this down doesn't let water vapor remain on the down; and the water repellent layer formed by the present invention is even more durable and long-lasting, so that the down products can maintain their fluffiness and favorable heat retention property for longer time periods.

According to the production method of the present invention, the types of water-drawing agents, two of the most preferred manufacturing process embodiments, and more detailed description for the way of use of the present invention are provided below:

First embodiment: relates to the example where fluorocarbon functional group is used as the water-drawing agent, which comprises the steps of:

1. providing a water bath, adding 20-35 L of water into the water bath, keeping the water temperature between 35-40° C., and adjusting the pH value of the solution to be between 4-5 by adding glacial acetic acid, and then adding approximately 1 kg of cleaned down into the solution and allowing the cleaned down to be soaked completely;
2. adding the cross-linking agent comprising approximately 30-50 g of isocyanate (or acrylic acid) functional group dissolved in appropriate amount of water into the solution, and then adding the water-drawing agent comprising approximately 30-90 g of fluorocarbon functional group dissolved in appropriate amount of water into the solution;
3. actuating the stirring blades found in the water bath, and continuing the stirring operation for 15-30 minutes so that the cross-linking agent and the water-drawing agent would be completely reacted, and the water-drawing agent comprising fluorocarbon functional group can be evenly adhered on the surface of the down in order to form the water repellent layer;
4. said solution is discharged from the water bath and dehydration process is performed on the down, and following dehydration, stirring blades are kept working in order to loosen the down;

5. said down is baked by oven-drying for 40-60 minutes by means of dry air between the temperature of 120-140° C.;
6. following oven-drying of the down, it is cooled down to the room temperature, and thus water repellent down is produced.

Second embodiment: relates to the example where siloxane functional group is used as the water-drawing agent, which comprises the steps of:

1. providing a water bath, adding 20-35 L of water into the water bath, keeping the water temperature between 40-50° C., and adjusting the pH value of the solution to be between 4-5 by adding glacial acetic acid, and then adding approximately 1 kg of cleaned down into the solution and allowing the cleaned down to be soaked completely;
2. adding the cross-linking agent comprising approximately 10-20 g of isocyanate (or acrylic acid) functional group dissolved in appropriate amount of water into the solution, and then adding the water-drawing agent comprising approximately 50-70 g of siloxane functional group dissolved in appropriate amount of water into the solution;
3. actuating the stirring blades found in the water bath, and continuing the stirring operation for 15-30 minutes so that the cross-linking agent and the water-drawing agent would be completely reacted, and the water-drawing agent comprising siloxane functional group can be evenly adhered on the surface of the down in order to form the water repellent layer;
4. said solution is discharged from the water bath and dehydration process is performed on the down, and following dehydration, stirring blades are kept working in order to loosen the down;
5. said down is baked by oven-drying for 40-60 minutes by means of dry air between the temperatures of 120-140° C.;
6. following oven-drying of the down, it is cooled down to the room temperature, and thus water repellent down is produced.

In summation of the description above, the present invention overcomes the drawbacks of the prior art and properly controls the cost and improves the production capacity by a simple, easy and efficient operation process. While the invention has been described by means of specific embodiments, numerous modifications and variations could be made thereto by those skilled in the art without departing from the scope and spirit of the invention set forth in the claims.

What is claimed is:

1. A method for producing water repellent down, comprising, in the order recited:

soaking cleaned down in an aqueous solution having a pre-determined temperature and having a pH value ranging from 4 to 7;

adding to the aqueous solution containing the cleaned down a cross-linking agent that is dissolved in water and that is comprised of a material having an isocyanate functional group or an acrylic acid functional group to provide an amended solution having a weight ratio of the cleaned down and the cross-linking agent ranging between 1:0.005 and 1:0.06;

adding to the amended solution a water-drawing agent that is dissolved in water and that consists essentially of a material having a siloxane functional group to provide a second amended solution having a weight ratio of the cleaned down and the water-drawing agent ranging between 1:0.01 and 1:0.1;

stirring the second amended solution for at least 15 minutes to react the cross-linking agent and the water-drawing agent and form a water repellent layer on the surface of the cleaned down and provide water repellent down separating the water repellent down from the second amended solution by draining; and oven drying the water repellent down with hot air having a temperature of at least 120° C.

2. The method according to claim 1, wherein the cleaned down and the aqueous solution during soaking have a weight ratio of the cleaned down and the aqueous solution ranging between 1:20 and 1:35.

3. The method according to claim 1, wherein the cleaned down and the cross-linking agent have a weight ratio of the cleaned down and the cross-linking agent ranging between 1:0.01 and 1:0.05.

4. The method according to claim 1, wherein the cleaned down and the water-drawing agent have a weight ratio of the cleaned down and the water-drawing agent ranging between 1:0.05 and 1:0.07.

5. The method according to claim 1, wherein stirring the second amended solution continues for 30 minutes at most.

6. The method according to claim 1, wherein, prior to oven drying, the water repellent down is loosened by stirring.

7. The method according to claim 1, wherein the hot air employed during oven-drying has a temperature ranging between 120° C. and 140° C.

8. The method according to claim 1, wherein the pH value of the aqueous solution employed during soaking is adjusted by addition of glacial acetic acid to provide a pH value ranging between 4 to 5.

9. The method according to claim 1, wherein, the predetermined temperature of the aqueous solution during soaking is maintained through to and during stirring and ranges between 20° C. and 60° C.

* * * * *